United States Patent [19]

Robertson

[11] Patent Number: 4,783,217

[45] Date of Patent: Nov. 8, 1988

[54] METHOD AND APPARATUS FOR PRODUCING SPHERICAL OBJECTS

[76] Inventor: Harry J. Robertson, 1113 Woodland Rd., Salisbury, Md. 21801

[21] Appl. No.: 99,308

[22] Filed: Sep. 21, 1987

[51] Int. Cl.[4] ..... C22C 1/04

[52] U.S. Cl. ..... 75/0.5 B; 75/0.5 BA; 75/0.5 BB; 29/148.4 B; 264/5; 264/13; 264/14; 266/112; 266/166; 266/236; 419/30; 419/33

[58] Field of Search ..... 264/5, 13, 14; 75/0.5 B, 0.5 BA, 0.5 BB; 29/148.4 B; 266/112, 166, 236; 419/30, 33

[56] References Cited

U.S. PATENT DOCUMENTS 2,919,471 1/1960 Hechinger ..... 264/13

3,334,408 8/1967 Ayers ..... 419/30

*Primary Examiner*—Stephen J. Lechert, Jr.

*Attorney, Agent, or Firm*—Hurt, Richardson, Garner, Todd & Cadenhead

[57] ABSTRACT

A method and apparatus for producing spherical objects is disclosed, the apparatus having a reservoir filled with a relatively dense molten material, the reservoir being heated and hydraulically pressurized to maintain the molten state of the dense material. A second molten liquid, of lesser density and higher melting point is injected into the reservoir, the pressure and surface tension acting to force the injected material into a spherical form and the melting point difference acting to solidify the injected material.

18 Claims, 2 Drawing Sheets

METHOD AND APPARATUS FOR PRODUCING SPHERICAL OBJECTS

BACKGROUND OF INVENTION

Spherical objects, such as ball bearings, play an essential part in almost every mechanical operation. Superior bearings normally mean superior performance, with all its attendant advantages i.e. economy, efficient functioning etc. The more difficult task is the production of superior bearings. In order for the bearings to approach perfect spheres, environmental factors such as gravity must be minimized or overcome. Research has ranged from manufacturing operations in space in the absence of gravity to energy-intensive operations on earth using rotation and grinding to produce the sphere. Conventional grinding processes necessarily mean substantial material waste as the objects are ground into spherical form.

Examples of devices to manufacture spheres are found in U.S. Pat. Nos. 2,980,628 and 3,023,171 to Smith. These devices teach the manufacture of hydrogel spheroids of various composition, which material is dropped into an oil or gelling bath. The dropping tip or tips must be above the liquid level and the process is operated under superatmospheric pressure. The products float down through the bath and are collected out of the bottom of the device. Another example is found in U.S. Pat. No. 3,183,537 to Starr. The patent discloses a conduit for directing a stream of molten iron through the atmosphere and spraying the stream with hot water jets to break up the stream into globular granules.

Gravity and other factors affect both the shape and the density of bearings, both of which have a substantial effect on performance. Defects, however, are difficult to detect prior to actual failure since visual inspections provide little information. When actual failure does occur, the consequences may be both expensive and time consuming in terms of necessary repairs.

SUMMARY OF INVENTION

It is therefore, one of the principal objects of the present invention to provide a method and apparatus for producing spherical objects which use the physical properties of the materials to form the bearing material into spheres.

Another object of the present invention is to provide an apparatus for producing spherical objects which is easily constructed and maintained, and which is economical in operation.

A further object of the present invention is to provide a method of producing spherical objects which is suitable for producing spheriods from a wide range of materials and which method is economical relative to conventional grinding and polishing technology.

A still further object of the present invention is the production of essentially spherical objects which approach or obtain perfect roundness and which are economical and simple to produce.

Another object of the present invention is to provide a process of producing spherical objects under substantial pressure so as to produce a dense product.

Another object of the present invention is to provide a process of producing spherical objects in which the temperature and rate of cooling of the object is controlled.

These and additional objects are attained by the present invention which relates to a method and apparatus for producing spherical objects, the apparatus having a reservoir filled with a suitable high density liquid whose temperature is controlled. A conduit system, pump means, and associated valves are provided for the introduction of the subject bearing material in a liquid condition. In addition, a means is provided for easily removing and draining the finished products.

Briefly described, the method or process of the present invention involves providing a normally closed pressure vessel or a container with a relatively high density, low melting point or range, bath material, such as lead, therein. This high density bath material is maintained in its liquid condition by heat and is usually also maintained under high pressure. Into the bottom portion of this pressurized density liquid bath material is introduced successive, prescribed quantities or increments of a less dense higher melting point or range ball bearing material, such as steel or steel alloy, which is also heated to liquid condition. Because of the density differential, the successive, less dense higher melting material globs which are thus introduced into the bath material, float upward in the less dense liquid. The less dense material is also maintained at a temperature, less than the melting point or range of the ball bearing material so that, as the globs individually, successively float upwardly they are respectively solidified into the minimum volume spherical shape, so that by the time the globs respectively reach their uppermost position in the bath material, they are below their melting point and are thus each solidified in its prescribed spherical shape.

The pressure of the bath materia may be as low as 60 psi or less, but is usually in excess of 1,000 psi, so that the pressure on all sides of the liquid globs are essentially the same, whereby each glob is urged into its minimum volume, becoming essentially spherical and quite dense as the glob solidifies. Any entrained gases in the glob are under such great pressure as to occupy a minimum space as the glob solidifies. Also, the crystaline structure of the ball bearing material is more dense and uniform due to its solidification under heat and pressure to thereby provide a smooth uniform surface. This principle is based on Pascal's law which states that, "The pressure applied to a liquid at any point is transmitted equally in all directions; the pressure in a liquid not subjected to external forces is equal at all points." *Hackh's Chemical Dictionary,* Third Ed., 1944, p. 618. Pressure in the present apparatus and method is effected hydraulically, thus obviating problems and higher costs associated with pressurization by gases.

Various liquids may be used for the operation, and the operation may also entail the introduction of the bearing material at or near the top of the vessel, where it gradually falls to the bottom, being formed into spheres on the way down. The requirements for either operation are the difference in densities and the immiscibility and non-reactiveness of the respective liquids.

Various additional objects and advantages of the present invention will become apparent from the following description, with reference to the accompanying drawings.

DETAILED DESCRIPTION OF THE PREFERRED EMBODIMENT

Figure 1:
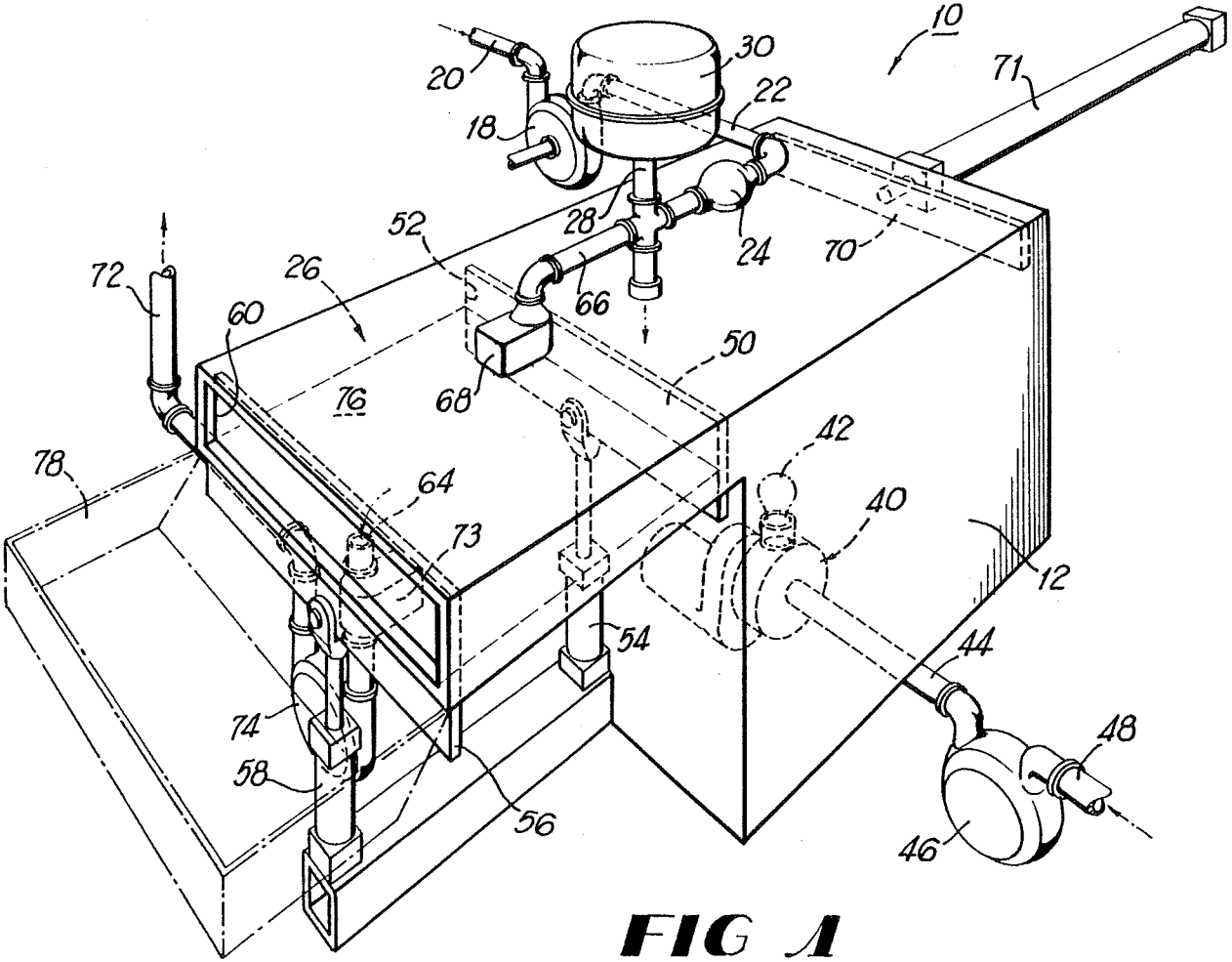
FIG. 1 is a perspective view of an embodiment of the apparatus for producing spherical objects.

Referring now more specifically to the drawings, and to FIG. 1 in particular, numeral 10 designates generally the apparatus for producing spherical objects. The apparatus may have different design features than those illustrated, for example the height of the reservoir may be varied; however, the invention generally incorporates the features shown. Certain features are conventional and have not been illustrated in great detail, these being the positive displacement pumps; heated conduits to maintain the temperature of the liquids, the heat being provided through heating coils around the conduits, induction heating, or internally disposed heating means in the conduit walls; a source of electrical and hydraulic power; and control means including automatically operated valves for the hydraulic fluid and electronic controls for operating the present apparatus. The embodiment shown, however, is representative and discloses the preferred embodiment.

In the present invention, the apparatus includes a pressure vessel or reservoir 12, within which is disposed a high density liquid, low melting point or range, bath material, such as molten lead 14. The walls of the reservoir 12 are formed from a suitable material such as a high melting point metal or refractory material having a greater melting point than the bath material i.e. the lead and preferably a metal or refractory having a melting point higher than any material used for forming the spherical objects. The walls may be insulated to help maintain the elevated temperature. For example, the molten lead bath material 14 has a melting point of 327.4° C., and thus the walls of pressure vessel or reservoir 12 could be formed from iron which has a melting point of 1535° C., thereby assuring that there will be no appreciable destruction of the reserooir 12 by material contained therein.

Heating means, such as coils 16, are disposed around the walls of the reservoir 12 or induction heating is used to raise the temperature of the bath material to a suitable level and to maintain the temperature at a relatively constant level, keeping the bath material 14 in a liquid state. The reservoir 12 is a closed system and may be pressurized through a suitable means, such as a positive displacement pump 18. The pump 18 which maintains the pressure on the molten liquid bath material 14 in the reservoir 12, is similar to a hydraulic system, and this pressure may range from near zero pressure to whatever pressure is required, limited only by the strength of the various components which contain the pressurized liquid bath material 12. For example, pressures could be maintained at 1,000 psi and as high as one thousand atmospheres (1000 atm) for certain applications. In addition, higher pressures normally translate into lower heating requirements.

The intake of pump 18 is supplied with the molten bath material 14 via conduit 20 which extends from a furnace (not shown) or similar means. Extending from the discharge side of the pump 18 is a second conduit 22, having a check valve therein at 24, the valve 24 itself not being shown. Conduit 22 supplies the liquid bath material 14 to the top of reservoir 12 and also to the top of the chamber 26 which chamber 26 receives the finished spheres in a manner to be detailed, hereinbelow.

Disposed at a level above the reservoir 12, and also connected to conduit 22 by an upwardly extending conduit 28, is an accumulator tank 30. The accumulator tank 30 may also be heated and is under the same hydraulic pressure as reservoir 12. The accumulator tank 30 is for the purpose of assuring that resevoir 12 is filled and remains filled with liquid bath material 14 which remains at a constant prescribed pressure. Communicating with the accumulator tank 30 is a sump tank or reservoir (not shown) or similar arrangement to allow ingress or egress of excess liquid bath material 14 to and from reservoir 12. Thus, as successive globs of bearing material are ntroduced through the bottom of reservoir 12 to produce the spheres 42, the excess material may be conveniently forced into the accumulator tank 30, and back through to the sump. This provides the necessary room for expansion of the overall volume in the closed system due to the introduction of the bearing material.

A valve means 40 is located normally at or near the bottom of the reservoir 12 for the introduction of the molten bearing material which is to be formed into successive globs to produce the spherical objects 42. The valve 40 may be any of a number of suitable types, the valve 40 being shown here as rotatable, although other types may also be used. The valve 40 communicates through conduit 44 to a positive displacement pump means 46 which supplies the molten bearing material to the present apparatus from conduit 48. Conduit 48 extends from a suitable furnace or other source at which the bearing material is melted. The bearing material used to form the bearings or spheres 42 will normally be one in which the melting point is well above that of the bath material 14. Thus, upon introduction into the reservoir 12, the bearing material, under the hydraulic pressure, begins to progressively cool and solidify into a configuration having the least possible volume, that of a sphere. The pressure produces a forged type ball of bearing material, having few deflects.

For permitting the discharge of the formed solidified balls or spheres 42, the reservoir 12 is provided with a sidewise opening, discharge tank or chamber 26 having a pair of spaced gate valves 50 and 56. The first or inner gate valve 50 seals the reservoir 12 and the second or outer gate valve 56, when closed, confines the finished spherical objects 42 within chamber 26. As shown in FIG. 1, when the first gate valve 50 is in a closed position, it seals the reservoir 12 by closing port 52. The first or inner gate valve 50 is raised and lowered by a suitable device, such as a hydraulic piston and cylinder 54. The second or outer gate valve 56, shown in open position in FIG. 2, acts as a secondary seal to confine the bath material in the reservoir 12 and chamber 26 as the finished spheres and some bath 14 are received pass through port 52 into the chamber 26. The outer gate 56 is also operated by a suitable device, such as hydraulic cylinder 58. This second gate 56 closes a discharge port 60 at the outer end of chamber 26. The entire operation is effectively controlled by a suitable electronic control means 62. Disposed near the outlet or discharge port 56 in or near the floor of chamber 26, is a drain 64. In practice, and to maintain the closed system, a lock or similar arrangement is normally provided which can be filled and emptied, as needed, to maintain the pressure in the reservoir 12. Thus, while production of the spheres 42 is occurring, the inner gate 50 is closed to maintain the closed system.

Prior to the removal of the finished spheres 42, the second gate 56 is closed and the chamber 26 is filled with the same material 14 as is in the reservoir 12 through conduit 66 and valve means 68. This equalizes the pressure in chamber 26 and reservoir 12. When gate 50 is opened a rake or bar means 70, having a suitable operator, such as a hydraulic piston and cylinder 71, is activated to push the floating spheres 42 from reservoir 12 into the top of the chamber 26. The first gate 50 is then closed and the molten material in the chamber 26 drained off through drain 64. From the drain 64, the molten material is pumped through valve 73 and then through heated conduit 72, by a second positive displacement pump 74, the bath material 12 being eventually recycled to the conduit 20.

With chamber 26 drained, and the spheres 42 partially cooled and solidified by their introduction into the relatively cooler bath material 14 in chamber 26, the outer gate 56 is opened, so that its outwardly sloping floor 76 permit the spheres 42 to roll into a collection bin 78 or similar device which may be filled with water 80 or other coolant means to further cool the spheres 42.

Figure 2:
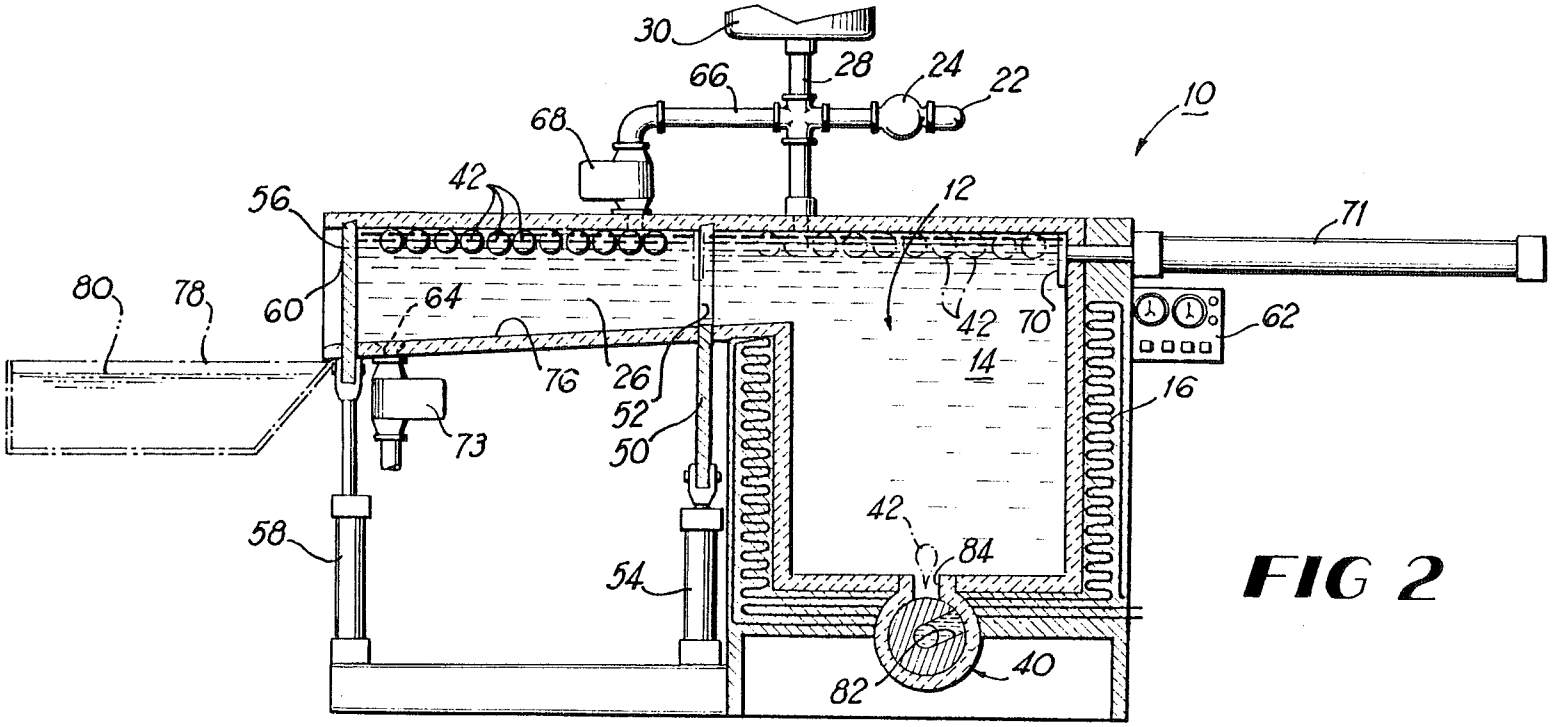
FIG. 2 is a side elevational view, shown partially in cross section, of the apparatus shown in the previous figure, shown here during operation.
Figure 3:
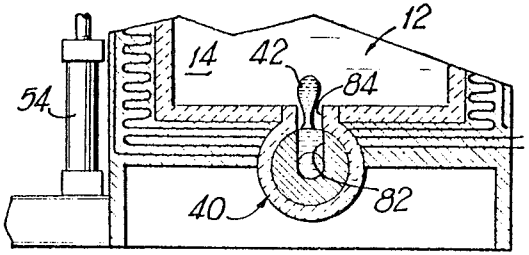
FIG. 3 is a partial side elevational view, shown partially in cross section, of the present invention, shown here in the process of discharging the finished products.

The present method can readily be explained with reference to FIGS. 2 and 3. The relatively high density liquid medium which forms the bath material 14 in the reservoir 12 is heated to and maintained at or above its melting point. The molten bearing material used to form the spheres 42 is injected by pump 46 into a rotary metering valve 40 which provides an inlet as the valve port 82 makes communication with conduit 44. As the valve rotates, port 82 makes communication with the valve outlet 84 in the interior of the reservoir 12. Successive measured increments of the liquid lighter density bearing material exit the valve 40 and migrate upwardly by buoyancy toward the top of the reservoir 12. As the material rises, the pressure applied by the high density liquid, forces the successive globs of material into a spherical shape, that of least volume while the relatively lower temperature of the reservoir contents cools and solidifies the material. The spheres 42 are able to approach perfection due to the artificial absence of gravity effected by the differing densities of the materials, the effective lack of any forces which might disrupt the intermolecular attractive forces of the individual molecules, and the pressurized environment, which effectively squeezes out imperfections in the crystal structure.

After the discharge of the material from the valve 40, the valve 40 rotates toward the conduit 44 to be recharged. The size of the spheres 40 produced, can be controlled by the size of the valve opening and the speed of rotation. Thus, faster rotation will produce smaller spheres while the converse is true for slower rotation, subject to the size limitations of the valve 40.

A number of suitable liquid materials may be used for the liquid bath materials in the reservoir 12 and for the bearing material to be formed into spheres 40. The materials chosen must only have certain characteristics relative to one another. They must be immiscible in and inert to one another and they must have different densities so that the material introduced will either rise toward the top of the the reservoir or fall toward the bottom, depending on the combination of materials used. The injected bearing material must also have a higher melting point than the relatively dense bath material 14 in the reservoir 12 for cooling and solidifying purposes.

With these limitations, examples of suitable bath materials include lead, having a melting point of 327.4° C. and a density of 11.34 g/CC, and steel for th material introduced therein. The melting point of the steel will vary according to its composition, as will the density; however, the process need only be confined to the stated parameters. Another possible modification involves the selection of materials which are not only non-reactive and immiscible, but which have specific densities that are close to each other so as to create a slow rate of ascent or descent of the bearing material introduced to the reservoir. Other possibilities for the material used to form the spheres 42 would include aluminum, iron and similar hard metals, certain alloys, and even certain non-reactive plastics, which could be formed into spheres in a reservoir filled with water.

While an embodiment of a method and apparatus for producing spherical objects and modifications thereof have been shown and described in detail herein, various additional changes and modifications may be made without departing from the scope of the present invention.

I claim:

1. An apparatus for producing spherical objects comprising a reservoir means having an inlet for providing access to the interior of said reservoir and an outlet for said spherical objects, a relatively dense liquid material disposed in said reservoir and substantially completely filling said reservoir, a first pump means for supplying said relatively dense liquid to and for hydraulically pressurizing said reservoir, a conduit means extending from said inlet and having a valve means at the interface of said conduit means and said inlet, a second pump means in operative communication with said conduit means for forcing therethrough and into said valve means a liquid material having a lesser density than said relatively dense liquid in said reservoir, said valve means being selectively operable to convey said lesser density material to said inlet and to release said lesser density material into said relatively dense material whereby said lesser density material migrates through buoyancy toward said outlet of said reservoir, the pressure from said first pump means and the difference in relative densities forcing said lesser density material into spherical form.

2. An apparatus as defined in claim 1 in which said apparatus includes a double gate means near said outlet for maintaining the pressurized liquid in said reservoir and for discharging the spherical objects produced therein.

3. An apparatus as defined claim 1 in which said reservoir includes heating means for raising and maintaining the temperature of said dense liquid to a point above the melting point of said dense liquid.

4. A method of producing spherical objects comprising the steps of:

(a) heating a first metal to molten condition;

(b) restricting said first metal in a confined area in its molten state;

(c) maintaining the temperature of said first metal at a prescribed level sufficient to maintain said first metal in its molten condition;

(d) heating to molten condition a second metal which has a density in a molten condition less than the density of said first metal, said second metal in its molten state being essentially nonreactive and immiscible with said first metal in its molten state, said second metal having a melting point higher than said prescribed temperature of said first metal;

(e) introducing successive measured increments of said second metal into the interior of said molten first metal while maintaining said second metal in a molten condition whereby said successive increments migrate by buoyancy upwardly in said molten first metal and are cooled from a molten state to a solid state during such period of migration to produce successive spherical objects; and (f) removing said spherical objects from said first metal while said first metal is in its molten state.

5. The method defined in claim 4 including the step of pressurizing said first molten metal in said confined area.

6. Process for producing prescribed shaped objects comprising:

(a) disposing a dense first liquid which is a solid at room temperature at a first temperature in a confined volumetric area;

(b) from a confined area into said first liquid, beneath the surface of said first liquid, a second liquid at a second temperature higher than said first temperature so that said second liquid is cooled by said first liquid and is moved by buoyancy in said first liquid, said second liquid solidifying at a temperature greater than the temperature of said first liquid so that it solidifies as it moves in said first liquid.

7. A process for producing a prescribed shape objects, comprising:

(a) heating a relatively dense material to a temperature sufficient for said material to exist in a liquid condition as a first liquid;

(b) disposing said material in a confined area so that said first liquid has a depth in excess of the height of the objects to be produced;

(c) maintaining the temperature of said material sufficiently high that the material remains in its liquid condition;

(d) heating a second material, which is less dense than said first liquid and which will solidify at the temperature above the temperature of said first liquid, to a temperature at which said second material exists as a second liquid;

(e) maintaining the second liquid in a liquid condition at a temperature higher than the temperature of the first liquid while moving said second liquid in a confined path toward said first liquid; and (f) introducing a prescribed amount of said second liquid from its confined path directly into said front liquid below the surface of said first liquid so that said second liquid will move upwardly in said first liquid and is cooled during such movement into a solidified condition.

8. A process as defined in claim 6 in which said first liquid has a density different from the density of said second liquid.

9. A process as defined in claim 6 in which said first liquid has a density greater than the density of said second liquid.

10. A process as defined in claim 9 and including the further steps of collecting said solidified objects from said dense first liquid and subjecting said solid objects to a liquid medium having a temperature less than that of said first liquid.

11. An apparatus as defined in claim 2 in which said double gate means includes at least an inner gate and an outer gate, forming a chamber therebetween, and said apparatus includes means for pressurizing said chamber.

12. An apparatus as defined in claim 11 in which said means for pressurizing said chamber include a conduit means operatively connected with said chamber and with said first pump means for filling said chamber with pressurized liquid.

13. Process of producing a spherical metal object, comprising:

(a) disposing a relatively dense cooling medium having a liquid phase in a chamber;

(b) heating said cooling medium to at least a temperature in which said cooling medium is in its liquid phase within said chamber;

(c) maintaining the temperature of said cooling medium at a prescribed temperature sufficiently high that said cooling medium remains in its liquid phase;

(d) pressurizing said chamber with said cooling medium in said chamber;

(e) heating to a liquid phase a less dense metal, which melts at a higher temperature than said prescribed temperature;

(f) injecting a prescribed amount of the liquid metal into the pressurized liquid cooling medium, below the uppermost level of said cooling medium so that said prescribed amount forms into a molten globular mass within and below the upper surface said pressurized cooling medium and so that said globular mass is buoyed upwardly within said pressurized liquid cooling medium and is progressively cooled by said pressurized liquid cooling medium and the pressure of said medium is exerted on all sides of said globular mass throughout the portion of its travel in which said globular mass is liquid, said globular mass going from its liquid phase to its solid phase while it is entirely submerged in said pressurized liquid cooling medium.

14. The process defined in claim 13 in which the injection said liquid metal into said cooling medium is at the bottom portion of said chamber.

15. The process defined in claim 14 in which the step of injecting liquid metal into said cooling medium includes confining the liquid metal in a conduit communicating with said chamber and applying pressure to said liquid metal sufficient to move said metal liquid metal into said cooling medium.

16. The process defined in claim 13 wherein the pressure in said chamber is in excess of 1000 p.s.i.

17. The process defined in claim 13 wherein said cooling medium is a metal.

18. The process defined in claim 13 wherein said cooling medium is mercury.

* * * * *